United States Patent [19]

Haruta et al.

[11] Patent Number: 4,836,172

[45] Date of Patent: Jun. 6, 1989

[54] CANISTER DEVICE FOR USE IN GASOLINE TANK

[75] Inventors: Kazumi Haruta, Obu; Yutaka Yamada, Hekinan, both of Japan

[73] Assignee: Aisan Kogyo Kabushiki Kaisha, Ohbu, Japan

[21] Appl. No.: 103,671

[22] Filed: Oct. 2, 1987

[30] Foreign Application Priority Data

Oct. 6, 1986 [JP] Japan ..... 61-238735
Oct. 9, 1986 [JP] Japan ..... 61-241805

[51] Int. Cl.[4] ..... F02M 39/00

[52] U.S. Cl. ..... 123/520; 123/521; 55/316

[58] Field of Search ..... 123/518, 520, 521, 516, 123/519; 55/387, 316

[56] References Cited

U.S. PATENT DOCUMENTS

| | | | |
|---|---|---|---|
| 3,491,736 | 1/1970 | Walker | 123/521 |
| 3,779,224 | 12/1973 | Tagawa | 123/518 |
| 3,884,204 | 5/1975 | Krautwurst et al. . | |
| 3,913,545 | 10/1975 | Haase | 123/520 |
| 4,149,504 | 4/1979 | Walters . | |
| 4,448,594 | 5/1984 | Kozawa | 123/519 |
| 4,475,522 | 10/1984 | Oonaka | 123/520 |
| 4,496,379 | 1/1985 | Kozawa | 123/519 |
| 4,630,581 | 12/1986 | Shibata | 123/520 |
| 4,658,797 | 4/1987 | Brand | 123/520 |
| 4,683,862 | 8/1987 | Fornuto | 123/520 |
| 4,702,216 | 10/1987 | Haruta | 123/520 |
| 4,758,255 | 7/1988 | Yamada | 123/519 |

FOREIGN PATENT DOCUMENTS

| | | | |
|---|---|---|---|
| 168490 | 12/1980 | Japan . | |
| 172649 | 12/1980 | Japan . | |
| 57-17721 | 1/1982 | Japan . | |
| 57-17723 | 1/1982 | Japan . | |
| 19188 | 2/1982 | Japan . | |
| 123953 | 8/1982 | Japan . | |
| 0157053 | 9/1982 | Japan | 123/520 |
| 0119956 | 7/1983 | Japan | 123/520 |
| 0029761 | 2/1984 | Japan | 123/520 |
| 0176456 | 10/1984 | Japan | 123/520 |
| 1217347 | 12/1970 | United Kingdom | 123/520 |

*Primary Examiner*—Carl Stuart Miller
*Attorney, Agent, or Firm*—Cushman, Darby & Cushman

[57] ABSTRACT

A canister device is used to collect fuel vapors generated in a vapor space within a gasoline tank and those generated in a filler neck thereof while the tank is being filled in a vapor absorbing material accommodated therein. The accumulated fuel vapors are purged from the canister utilizing the source of vacuum generated in an intake manifold while the engine is running. The canister device includes a casing accommodating a vapor absorbing material layer, a first intake port provided at the intermediate portion of the casing and communicating with the vapor space in the fuel tank, a second intake port provided in one side wall of the casing and communicating with the interior of the filler neck of the fuel tank, an air port provided on the other side wall of the casing and opened into air ambient the casing, and a purge port communicating with the source of vacuum and positioned at a location or two of the casing such that the air flowing into the canister through the air port is discharged through the vapor absorbing material layer.

11 Claims, 6 Drawing Sheets

CANISTER DEVICE FOR USE IN GASOLINE TANK

BACKGROUND OF THE INVENTION

1. Field of the Invention

The present invention relates to a canister device for use in a gasoline tank.

2. Description of the Prior Art

Known evaporation control systems for limiting the discharge of fuel vapors generated in a fuel tank of a vehicle have been disclosed in the specification of, for example, Japanese Utility Model Laid-Open No. 123953/1982 and U.S. Pat. No. 3,884,204.

In the system disclosed in Japanese Utility Model Laid-Open No. 123953/1982, the fuel vapors evaporated into a vapor space of a fuel tank from gasoline stored in the fuel tank are collected, while the engine is stopped, in a fuel vapor absorbing canister (hereinafter referred to simply as a canister) by a vent conduit through a check valve therein, and are absorbed by and stored in an active vapor absorbing material, such as activated carbon, filling in the canister.

While the engine is operating, a source of vacuum generated in an intake manifold is utilized to remove the accumulated fuel vapors from the vapor absorbing material in the canister and draw them into the intake manifold by a purge conduit for consumption in the engine combustion process.

This system, however, is not equipped with means for collecting the fuel vapors evaporated into a filler neck of the gasoline tank from the gasoline which is being filled into the tank, and is therefore not suitable for conforming with the recent tendency of restricting the discharge of fuel vapors into the atmosphere to avoid air pollution.

The vapor loss control system disclosed in U.S. Pat. No. 3,884,204 includes a first canister in which the fuel vapors generated in a vapor space in the gasoline tank are collected by a first vent conduit, and a second canister in which the fuel vapors generated in a filler neck of the fuel tank while the tank is being filled are accumulated by a second intake conduit. The canisters are purged when the engine is running by utilizing the vacuum source generated in the intake manifold to remove the vapors therefrom and draw them into the intake manifold through purge conduits provided for the respective canisters.

This system, however, has a disadvantage in that the number of steps required for assembly and the number of parts are increased because a pair of canisters are used, increasing the production cost.

In the system disclosed in the specification of Japanese Utility Model Laid-Open No. 123953/1982, the fuel vapors generated from the fuel tank and a carburetor bowl are collected in one canister by two separate intake conduits, and the absorbed fuel vapors are purged from the canister to the intake manifold through a purge conduit. The above-described problem of the prior art is obviated if the canister of the above system is used to collect, by separate intake conduits, fuel vapors generated in the vapor space in the gasoline tank and fuel vapors generated in the filler neck of the fuel tank. The canister of this arrangement generally communicates with two intake conduites at one end surface thereof, but this arrangement produces the following problem: the temperature of the gasoline stored in the fuel tank is higher than that of the gasoline to be poured into the tank. As a result, the fuel vapors collected in the vapor space in the gasoline tank contains a large amount of high-boiling components, while the fuel vapors evaporated into the interior of the filler neck of the fuel tank from the gasoline which is being poured into the tank while the tank is being filled contains a large amount of low-boiling components. The activated carbon which fills the canister as an active vapor absorbing material has characteristics such that it does not readily release the high-boiling components of the absorbed gasoline, reducing the absorption efficiency thereof. Therefore, if the fuel vapors evaporated from the gasoline stored in the gasoline tank are collected in the canister from one end surface thereof and are absorbed in the active vapor absorbing material consisting of activated carbon, the large amount of high-boiling components contained in the fuel vapors spread all over the active vapor absorbing material, reducing the absorption efficiency of the material at an early stage of its use and also deteriorating the function of the canister.

SUMMARY OF THE INVENTION

Accordingly, it is an object of the present invention to improve the collection of fuel vapor emissions from the fuel supply system by the provision of a canister device in which the fuel vapors generated from the gasoline stored in the fuel tank and those generated from gasoline poured into the fuel tank are collected in one canister, with the former fuel vapors being absorbed in part of the active vapor absorbing material filling the canister and the latter vapors being absorbed in all of the active vapor absorbing material in the canister.

Another object of the present invention is to improve the collection of fuel vapor emissions by the provision of a canister device which comprises a canister accommodating two separate vapor absorbing material layers, and in which the fuel vapors generated from the gasoline stored in the gasoline tank and those generated from gasoline poured into the fuel tank are collected separately in the two vapor absorbing material layers and are purged separately therefrom.

The present invention provides, in one of its aspects, a canister device for use in a gasoline tank, which comprises a canister including: a casing accommodating a vapor absorbing material layer; a first intake port provided at the intermediate portion of the casing such that the first intake port communicates with the intermediate portion of the vapor absorbing material layer; a second intake port and a purge port which are provided in one of the side walls of the casing such that the second intake port and the purge port communicate with one of the side surfaces of the vapor absorbing material layer; and an air port provided in the other side wall of the casing such that the air port communicates with the other side surface of the vapor absorbing material layer, wherein the first intake port is made to communicate with the interior of a vapor space within the gasoline tank while the second intake port is made to communicate with the interior of a filler neck of the gasoline tank.

The present invention provides, in another of its aspects, a canister device for use in a gasoline tank, which comprises a canister including: a casing accommodating a vapor absorbing material layer; a first intake port and a first purge port which are provided at the intermediate portion of the casing such that the first intake port and the first purge port communicate with the intermediate portion of said vapor absorbing material layer; a second intake port and a second purge port which are provided in one of the side walls of the casing such that the second intake port and the second purge port communicate with one of the side surfaces of the vapor absorbing material layer; an air port provided in the other side wall of the casing such that the air port communicates with the other side surface of the vapor absorbing material layer; and a screen plate formed such that it separates a first vapor absorbing material layer portion located below the first intake port and the first purge port from a second vapor absorbing material layer portion which forms a portion of the vapor absorbing material layer which is not the first vapor absorbing material layer portion, and that air flows from the air port into the first vapor absorbing material layer portion located below the first intake port and the first purge port, wherein the first intake port is made to communicate with a vapor space within the gasoline tank while the second intake port is made to communicate with the interior of a filler neck of the gasoline tank.

DESCRIPTION OF THE PREFERRED EMBODIMENTS

Figure 1:
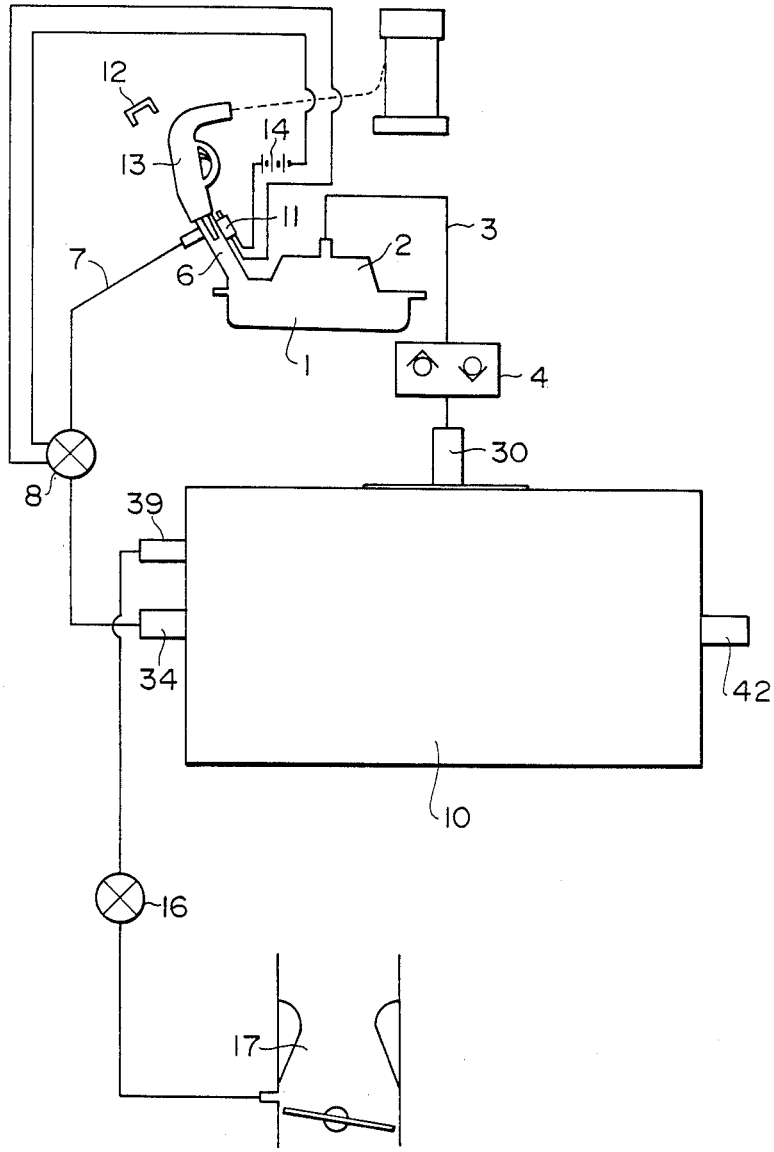
FIG. 1 is a diagram of fuel vapor collection system of a vehicle which incorporates a canister device of a first embodiment of the present invention.

FIG. 1 is a schematic diagram of a fuel supply system incorporating a canister device 10 for use in a gasoline tank in accordance with the present invention.

A fuel tank 1 is illustrated having a vapor space 2 in which fuel vapors generated from the gasoline stored in the fuel tank 1 are collected. A first intake conduit 3 is connected to the upper wall defining the vapor space 2 in communication with the interior thereof. The first intake conduit 3 communicates, at the other end thereof and through a check valve 4, with a first intake port 30 provided at the center of the upper surface of a lateral type canister 10. A second intake conduit 7 is connected to a filler neck 6 of the fuel tank 1 in communication with the interior thereof. The second intake conduit 7 also communicates, at the other end and through a solenoid valve 8 which functions to open and close the second intake conduit 7, with a second intake port 34 provided on one side surface of the canister 10. The filler neck 6 is provided with an electric switch 11 which is energized by the removal of a cap 12 of the filler neck 6 to open the solenoid valve 8, and which is deenergized by the mounting of the cap 12 to close the solenoid valve 8. Reference numerals 13 and 14 designate a filler nozzle and a battery, respectively. The canister 10 includes a purge port 39 on the side thereof at which the second intake port 34 is provided, and an air port 42 on the opposite side thereof. The purge port communicates through a solenoid valve 16 with an intake manifold 17 of the internal combustion engine.

Figure 2:
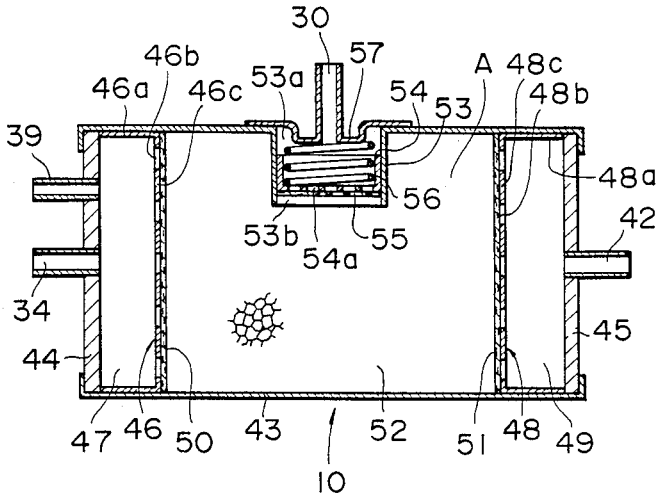
FIG. 2 is a longitudinal cross-sectional view of a canister, showing the first embodiment of the present invention.

FIG. 2 is a longitudinal cross-sectional view of the canister 10, showing a first embodiment of the present invention. A cylindrical casing 43 of the canister 10 is of a lateral type with its x is lying horizontal. The casing 43 is closed at one end by an intake chamber side wall 44 and the other end by an air chamber side wall 45. A retaining plate 46 comprises a cylindrical wall **46*a* having a diameter which allows it to be closely fitted into the casing 43, and a perforated plate 46*c* with many perforations 46*b* therein which is integrally formed with the wall 46*a* at one end thereof. The retaining plate 46 is fitted into the casing 43 in such a manner that the open end of the cylindrical wall 46*a* abuts against the inner surface of the intake chamber side wall 44 so as to form an intake chamber 47 between the perforated plate 46*c* and the intake chamber side wall 44. The second intake port 34 and the purge port 39 are provided in the intake chamber side wall 44 in such a manner that they are open into the intake chamber 47. Similarly, a retaining plate 48 comprises a cylindrical wall 48*a*, and a perforated plate 48*c* with many perforations 48*b* which is integrally formed with the wall 48*a* at one end thereof. The retaining plate 48 is fitted into the casing 43 in such a manner that the open end of the retaining plate 48 abuts against the inner surface of the air chamber side wall 45 so as to form an air chamber 49 between the perforated plate 48*c* and the air chamber side wall 45. The air port 42 is provided in the air chamber side wall 45 in such a manner that it is opened to the air ambient the canister 10 at one end and communicates with the interior of the air chamber 49 at the other end. A filter 50 and a filter 51 are fixed on the inner surfaces of the retaining plates 46 and 48, respectively, and thereby define a space therebetween in which an active vapor absorbing material which is activated carbon is filled to form an absorbing material layer 52. A tubular guide 53 is positioned at the center of the upper portion of the vapor absorbing material layer 52 with its axis directed in the vertical direction in the state wherein its upper end is fixed to the inner surface of the upper wall of the casing 43 and that the guide 53 is buried in the upper portion of the vapor absorbing material layer 52. An upper end portion 53*a* of the guide 53 and the upper wall of the casing 43 which corresponds to the upper end portion 53*a* are opened, while an lower end portion 53*b* of the guide 53 is opened into the vapor absorbing material layer 52. The inner diameter of the guide 53 is set such as to be very smaller than that of either of retaining plate 46 and 48. The vapor absorbing material is charged into the interior of the casing 43 through the hollow portion of the guide 53 to fill the accommodation section thereof which is formed between the filters 50 and 51 with the exception of the interior of the guide 53, as well as the lower portion 53*b* of the guide 53 with the vapor absorbing material and thereby form the vapor absorbing material layer 52. A cylindrical plunger 54 is slidably received in the guide 53. The plunger 54 has a diameter, i.e., a pressure receiving area, which is smaller than the diameter, i.e., the pressure receiving area, of either of the retaining plates 46 and 48. The plunger 54 has a bottom plate with vent holes 54***a* formed therein. A filter 55 is interposed between the bottom plate of the plunger 54 and the upper surface of the vapor absorbing material filling the lower portion of the guide 53. The outer diameter of the filter 55 is made slightly larger than the inner diameter of the guide 53, so that the outer periphery of the filter 55 is closely fitted to the inner surface of the guide 53 so as to eliminate the vapor absorbing material from entering between the guide 53 and the plunger 54 and thereby ensure smooth slide of the plunger 54. A spring 56 is accommodated in the upper portion of the plunger 54 which is placed on the upper surface of the vapor absorbing material layer 52, with the upper end of the spring 57 being pressed by a cap 57 in such a manner that the spring is compressed. The cap 57 which has been placed in this state is hermetically fixed to the upper wall of the casing 43 by welding or the like so that the plunger 54 is constantly urged downward by the elastic force of the spring 56. The volume of the guide 53, which is defined by the lower end of the guide 53 and the lower surface of the filter 55, is selected so as to be the same as or slightly larger than the volume of a space which would be formed between the upper surface of the recessed vapor absorbing material layer 53 and the upper wall of the casing 43 when the volume of the vapor absorbing material layer 52 is reduced by vibrations during use. The first intake port 30 is connected to the cap 57 in communication with the interior of the guide 53.

The function of the canister device of this embodiment will be described below. Fuel vapors evaporated from the gasoline stored in the fuel tank 1 and collected in the vapor space 2 while the cap 12 of the filler neck 6 is in place pass through the first intake conduit 3, the check valve 4, the first intake port 30, the interior of the guide 53, the vent holes 54*a* and then the filter 55 into the center of the upper portion of the vapor absorbing material layer 52. At this time, since the air port 52 is in communication with the air ambient the canister 10, the fuel vapors entering the canister 10 from the first intake port 30 are directed toward the air port 42 and are absorbed in the vapor absorbing material located near the air port 42. If the cap 12 of the filler neck 6 is in place, the electric switch 11 is de-energized so as to close the second intake conduit 7, and the fuel vapors produced from the stored gasoline do not therefore pass into the canister 10 through the second intake port 34.

When the tank is to be filled with fuel, the cap 12 is removed, and the electric switch 11 is energized to open the solenoid valve 8. As a result, the fuel vapors generated from the gasoline which is being poured into the tank and collected inside the filler neck 6 pass through the second intake conduit 7, the solenoid valve 8, the second intake port 34, the intake chamber 47 within the canister 10, the vent holes 46*b* in the retaining plate 46, then the filter 50, and are spread over the whole of one side of the vapor absorbing material layer 52 to be absorbed therein. The fuel vapors generated in the vapor space 2 of the fuel tank 1 while the tank is being filled are directed into the canister 10 in the above-described manner.

When the engine is stopped, the solenoid valve 16 in the conduit in communication with the purge port 39 is closed, preventing any fuel vapors which have entered the canister 10 from flowing into the intake manifold 17 through the purge port 39. This is important because a flow of vapors into the intake manifold 17 while the engine is not operating causes excessive enrichment of the predetermined air-fuel supply to the engine, reducing the startability thereof.

When the engine is started, the solenoid valve 16 is opened, so that the source of vacuum in the intake manifold 17 acts through the purge port 39 on the fuel vapors absorbed in the vapor absorbing material layer 52, removing them from the vapor absorbing material and drawing them through the purge port 39 into the intake manifold 17.

If the vapor absorbing material layer 52, which was placed in the canister 10 when the canister was assembled, is vibrated or the vapor absorbing material is broken, the vapor absorbing material becomes more closely packed, decreasing the voids therein and also decreasing the volume of the vapor absorbing material layer 52. This causes the plunger, which is pressed against the vapor absorbing material by the spring 56, to descend further into the vapor absorbing material layer 52, eliminating the space which would be created between the upper surface of the vapor absorbing material 52 and the casing 43, and thereby forcing the vapor absorbing material into each corner of the canister 10. In consequence, the upper surface of the vapor absorbing material is maintained in contact with the inner surface of the casing without creating a space therebetween, and non-passage of part of the fuel vapors through the vapor absorbing material can be thereby prevented.

As can be seen from the above description, in the first embodiment, the fuel vapors generated from the filler neck while the tank is being filled, as well as those generated from the vapor space in the fuel tank, can be collected in the canister, preventing the first type of fuel vapors from being discharged into and polluting the atmosphere. Further, a single canister is used to collect the first and second types of fuel vapors. Therefore, it is possible to reduce the number of assembly steps and the number of parts required for assembling a canister device, thereby reducing the production cost, compared to the known double-canister vapor loss control system. Still further, the fuel vapors which are produced within the fuel tank and contain a large amount of high-boiling components are made to enter the canister at a central portion thereof, causing them to be absorbed by about half of the vapor absorbing material which is located at the side of the air port. In consequence, reduction in the absorbing efficiency of the entire vapor absorbing material at an early stage of use can be eliminated, and the fuel vapors entering through the second intake port and containing a large amount of low-boiling components can be efficiently absorbed by the other half of the vapor absorbing material layer.

Figure 3:
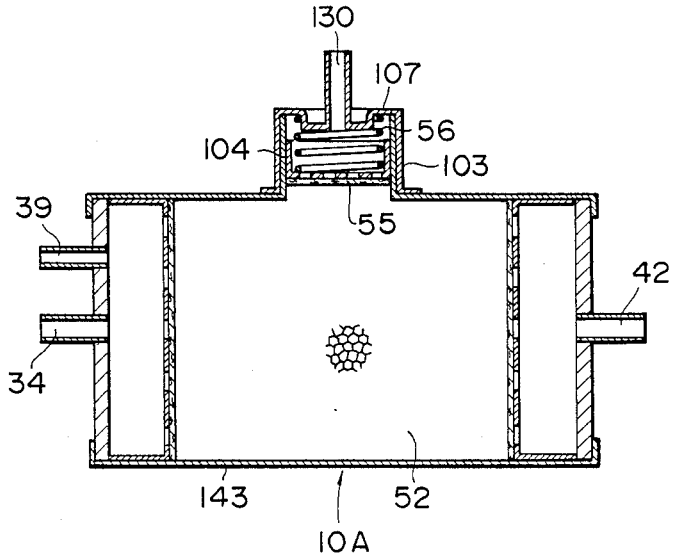
FIG. 3 is a longitudinal cross-sectional view of the canister, showing a second embodiment of the present invention.

FIG. 3 shows a canister 10A in a second embodiment of the present invention, in which like reference numerals designate the parts which correspond to those of the canister 10 of the first embodiment shown in FIG. 2. The canister 10A differs from the canister 10 of the first embodiment in that a guide 103 incorporating a plunger 104, the filter 55, and the spring 56 is not buried in the vapor absorbing material in the casing but is placed outside and on the upper surface of a casing 143. Other arrangements remain the same with those of the first embodiment. In this arrangement shown in FIG. 3, the fuel vapors entering the canister 10A through the second intake port 34 can be absorbed by the vapor absorbing material located in the whole area of the cssing, while in the arrangement shown in FIG. 2, the vapor absorbing material located in the vicinity of the air port 42, i.e., in an area indicated by A in FIG. 2 are hampered to absorb much of the fuel vapors entering through the second intake port 34.

Figure 4:
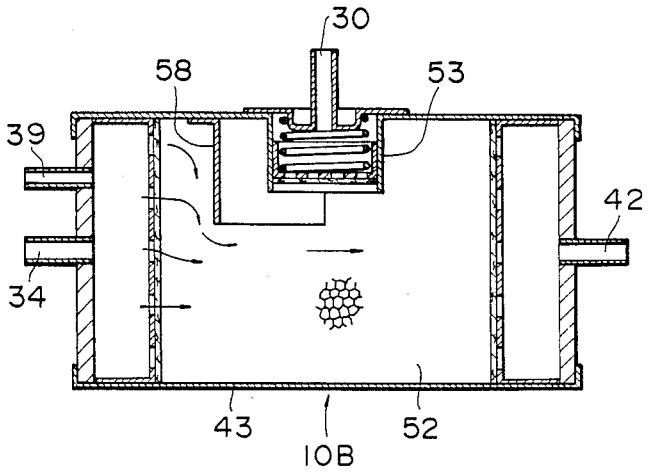
FIG. 4 is a longitudinal cross-sectional view of the canister, showing a third embodiment of the present invention.
Figure 5:
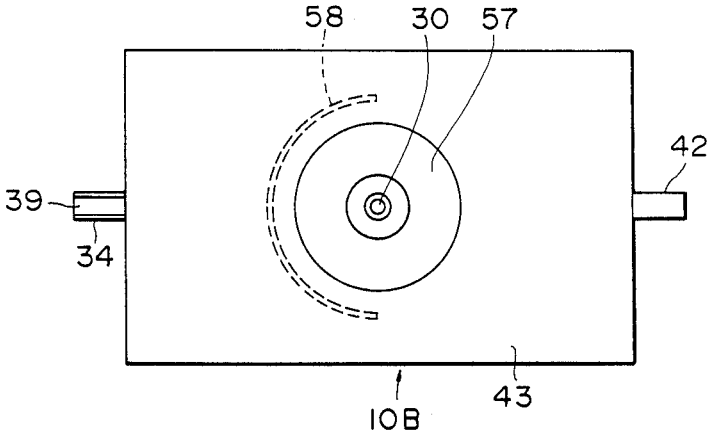
FIG. 5 is a plan view of the canister of FIG. 4.

FIGS. 4 and 5 show a canister 10B in a third embodiment of the present invention, in which like reference numerals designate the parts which correspond to those of canister 10 of the first embodiment shown in FIG. 2. The canister 10B differs from the canister 10 of the first embodiment in that it includes a flow directing plate 58 within the vapor absorbing layer 52 which is located between the second intake port 34 and the guide 53. The flow directing plate 58 is formed as a semi-circle which is coaxial with the cylindrical guide 53, as shown in FIG. 5, and is made to hang from the inner surface of the upper wall of the casing 43 at a position which is separated from the guide 53 by a predetermined distance. The lower end of the flow directing plate 58 is selected to locate slightly below the lower end of the guide 53. With this arrangement, a large amount of fuel vapors entering the canister 10*b* through the second intake port 34 are kept away from the guide 53 by the flow directing plate 58, so that the fuel vapors entering from the first intake port 30 are prevented from being pushed toward the air port 42 by the fuel vapors entering the canister from the second intake port 34 and being discharged from the air port 42 and polluting the atmosphere, before being absorbed by the vapor absorbing material.

Figure 6:
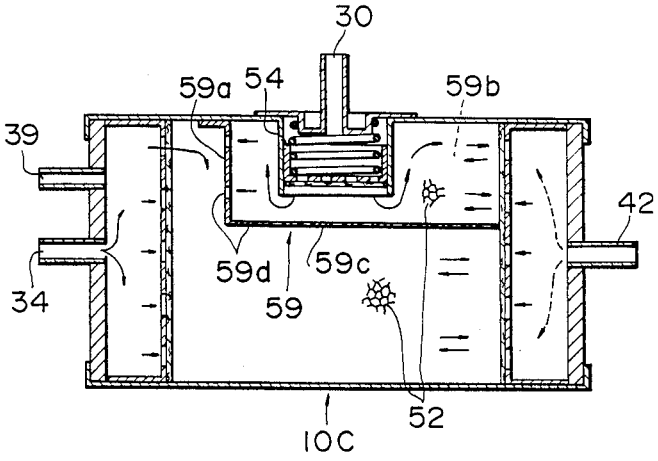
FIG. 6 is a longitudinal cross-sectional view of the canister, showing a fourth embodiment of the present invention.
Figure 7:
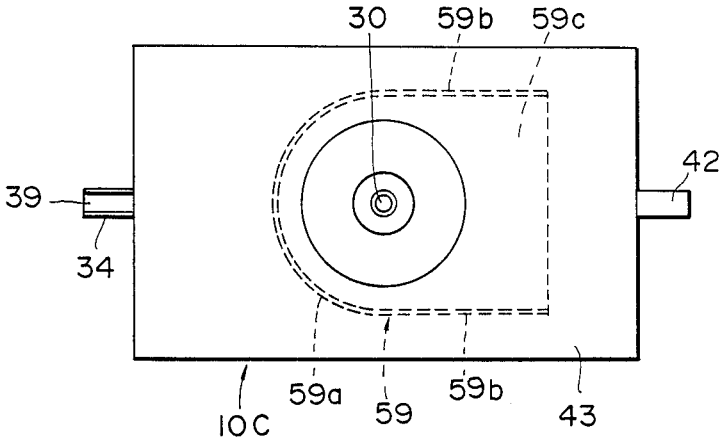
FIG. 7 is a plan view of the canister of FIG. 6.

FIGS. 6 and 7 show a canister 10C in a fourth embodiment of the present invention, in which like reference numerals denote the parts which correspond to those of the canister 10 of the first embodiment shown in FIG. 2. The canister 10C differs from the canister 10 of the first embodiment in that it includes a flow directing box 59 which comprises a flow directing plate 59*a* having the same configuration as that of the flow directing plate 58 shown in FIGS. 4 and 5, guide side wall portions 59*b* extending from both sides of the flow directing plate 59*a* until they reach the filter 51, and a bottom plate portion 59*c* flow directing plate 59*a* and the two side wall portions 59*b*, the flow directing plate 59*a*, the side wall portions 59*b*, and the bottom plate portion 59*c* being formed of a perforated plate with many through-holes 59*d* therein. In this arrangement shown in FIGS. 6 and 7, the fuel vapors hit against the bottom plate portion 59*c* of the flow directing box 59 when entering the canister 10C from the first intake port 30, are directed toward the upper portion of the vapor absorbing material located around the guide 53, as shown by the arrows, and are efficiently absorbed by the vapor absorbing material located in the entire area around the guide 53. The fuel vapors which enter the canister 10C from the second intake port 34 are kept away from the flow directing box 59, so that the fuel vapors entering the canister 10C from the first intake port 30 are prevented from being pushed toward the air port 42 in the same manner as in the third embodiment. When the fuel vapors are removed from the vapor absorbing material while the engine is running, the air flowing into the canister 10C from the air port 42 is circulated in the entire vapor absorbing material layer 52 through the through-holes 59*d* formed in the components of the flow directing box 59. Therefore, the fuel vapors can be removed effectively from the vapor absorbing material layer 52 in the entire canister 10C, despite the provision of the flow directing box 59. Further, the pressure of the plunger 54 which acts on the vapor absorbing material located within the flow directing box 59 can be transferred to the vapor absorbing material located outside the flow directing box 59 through the through-holes 59*d*. Therefore, the provision of the flow directing box 59 cannot be a barrier to carrying out the function of eliminating a space between the upper surface of he vapor absorbing material layer and the casing.

Figure 8:
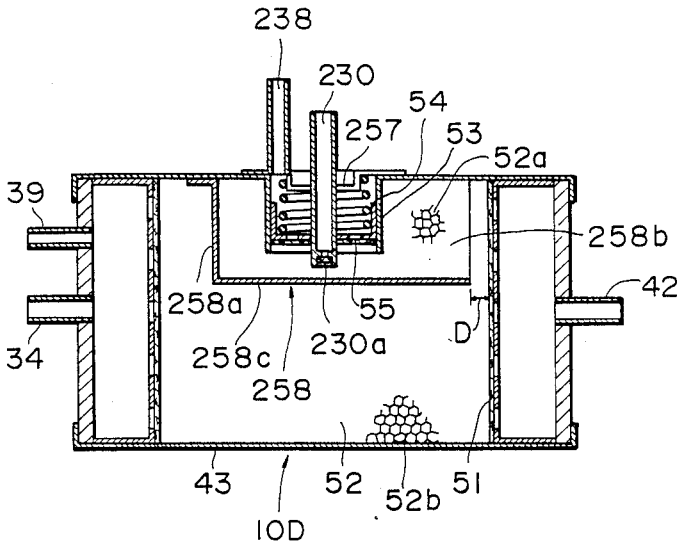
FIG. 8 is a longitudinal cross-sectional view of the canister, showing a fifth embodiment of the present invention.
Figure 9:
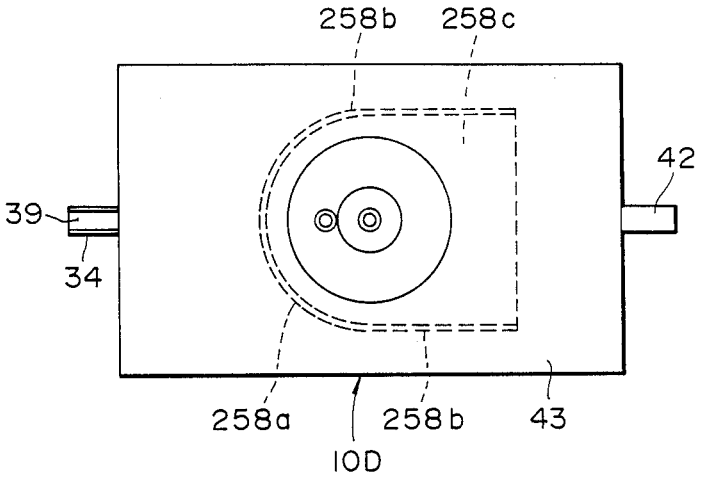
FIG. 9 is a plan view of the canister of FIG. 8.

FIGS. 8 and 9 show a canister 10D in a fifth embodiment of the present invention, in which like reference numerals denote the parts which correspond to those of the canister 10 of the first embodiment shown in FIG. 2. The canister 10D of this embodiment differs from the canister 10 of the first embodiment in the following points: a first intake port 230 and a first purge port 238 are provided in a cap 257 of the guide. The lower end of the first intake port 230 passes through the plunger 54 and the filter 55 into the lower portion of the guide 53. A filter 230*a* is mounted on the lower open end of the first intake port 230. The lower end of the first purge port 238 opened into the interior of the guide 53. The canister 10D includes a screen plate 258 which comprises: a flow directing portion 258*a* which is formed as a semi-circle which is coaxial with the cylindrical guide 53, the flow directing portion 258*a* being made to hang from the inner surface of the upper wall of the casing 43 at a position which is separated from the guide 53 by a predetermined distance; guide side wall portions 258*b* extending from two sides of the flow direction varying portion 258*a* to points at which they form a gap D between the ends thereof and the filter 51; and a bottom plate portion 258*c* covering the bottom of the area surrounded by the flow directing plate 258*a* and the side wall portions 258*b*, the bottom plate portion 258*c* being positioned slightly below the lower end of the guide 53. The screen plate 258 is adapted to divide the vapor absorbing material layer 52 in the canister 10D into a first vapor absorbing material layer 52*a* and a second vapor absorbing material layer 52*b*.

Function of the canister device of this embodiment will now be described. The fuel vapors evaporated into the vapor space 2 from the gasoline stored in the fuel tank when the cap 12 of the filler neck 6 is in place are directed through the first intake port 230 into the first vapor absorbing material layer 52*a* and are accumulated therein.

While the tank is being filled, the fuel vapors generated in the filler neck 6 pass through the second intake port 34, are spread all over the one end surface of the second vapor absorbing material layer 52*b*, and are accumulated in the entire area thereof. The fuel vapors generated in the vapor space 2 of the fuel tank while the tank is being filled pass through the first intake port 230 into the first vapor absorbing material layer 52*a* in the canister 10D in the same manner as when the fuel is not being filled.

When the engine is stopped, as in the first embodiment, no fuel vapors are prevented to pass through the second purge port 39 into the intake manifold 17.

When the engine is started, the source of vacuum in the intake manifold 17 acts on the fuel vapors accumulated in the first and second vapor absorbing material layers 52*a* and 52*b* through the first and second purge ports 238 and 39, removing them from the vapor absorbing material layers and drawing them into the intake manifold 17 through the purge ports 238 and 39.

Figure 10:
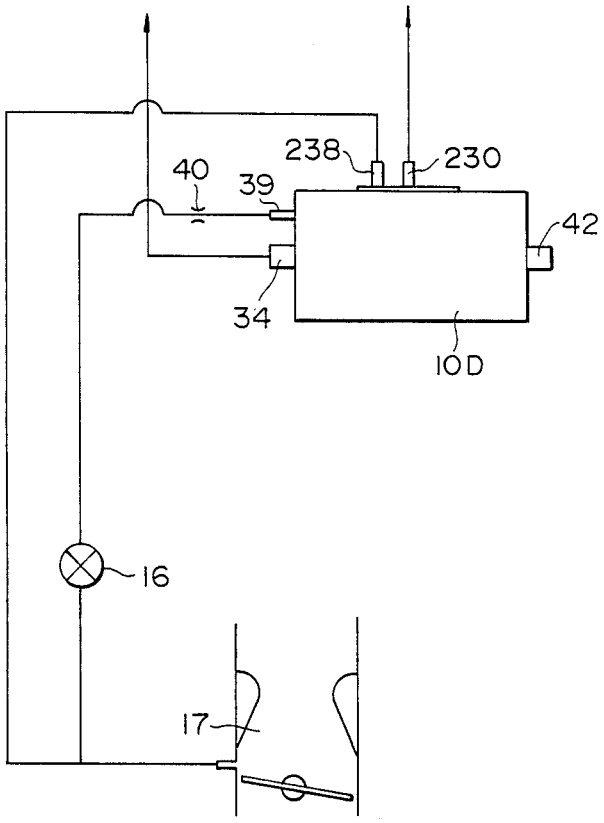
FIG. 10 is a fragmentary diagram of the fuel vapor collection system of a vehicle which incorporates the canister of FIG. 8.

The amount of fuel vapors which flow into the intake manifold 17 from the canister 10D through the second purge port 39 is restricted by a restricting valve 40 (see FIG. 10) provided in a conduit leading from the second purge port 39. This is important because a flow of a large amount of vapors into the intake manifold 17 causes excessive enrichment of the predetermined air-fuel supply to the engine and in turn excessive enrichment of the predetermined air-fuel mixture in the engine, adversely effecting the exhaust emissions from the engine and drivability of the vehicle.

If the volume of the first vapor absorbing material layer 52*a* is decreased by vibrations, the plunger 54 descends further into the first vapor absorbing material layer 52*a*, and the pressure which has acted on the first vapor absorbing material layer 52*a* is transferred to the second vapor absorbing material layer 52*b* through the gap D. In consequence, a space which would be created between the upper surfaces of the first and second vapor absorbing material layers 52*a* and 52*b* and the casing 43 by the decrease in the volume can therefore by absorbed by the descent of the plunger 54, and the vapor absorbing material can be forced into each corner of the casing 43.

As can be seen from the foregoing description, in the fifth embodiment, the vapor absorbing material in the canister is separated into two parts by the screen plate, the first vapor absorbing material accumulating the fuel vapors generated from the fuel tank and containing a large amount of high-boiling components. It is therefore possible to collect the fuel vapors containing a large amount of high-boiling components which deteriorates the absorption efficiency of the vapor absorbing material by part of the vapor absorbing material in the canister.

What is claimed is:

1. A canister device for use with a gasoline tank of a vehicle driven by a gasoline engine comprising:

a canister having a top wall and perforated partitions dividing the interior thereof into a chamber for containing a vapor-absorbing material and an intake chamber and an air chamber on the opposite sides of said material-containing chamber;

said intake chamber having a purge port and a first intake port in a wall of said canister, said first intake port being adapted to communicate with the interior of the filter neck of the gasoline tank;

said material-containing chamber having a second intake port in the top wall of said canister adapted to communicate with the vapor space in the gasoline tank;

said air chamber having an air port for communicating with ambient air outside of said canister;

an upright tubular guide at the inner end of said second intake port;

perforated plunger means reciprocable in said guide for engaging material in said material-containing chamber;

spring means urging said plunger inwardly of said second intake port; and filter means covering the inner end of said plunger.

2. The device defined by claim 1 including filter means covering the perforations in the partitions.

3. The device defined by claim 1 wherein the guide extends into the material-containing chamber and is adapted to be buried in the material therein.

4. The device defined by claim 1 wherein the guide extends outwardly of the material-containing chamber and the second intake port is at the outer end of said guide.

5. The device defined by claim 1 wherein the canister is cylindrical with opposed end walls, the partitions are circular and extend transversely of said canister, and the guide is cylindrical and the diameter thereof is far less than that of said canister.

6. The device defined by claim 1 wherein the second intake port is located about midway between the partitions.

7. The device defined by claim 1 including means in the material-containing chamber for directing the flow of vapor therein.

8. The device defined by claim 7 wherein the flow directing means is located adjacent the second intake port and directs the flow of vapor from the intake chamber into the material-containing chamber at locations spaced inwardly from the second intake port.

9. The device defined by claim 7 wherein the flow-directing means comprises perforated guide wall means including a semi-circular portion projecting into the material-containing chamber from a wall of the canister and extending about the second intake port, side portions extending from the ends of said semi-circular portion to the perforated partition of the air chamber and a bottom portion fixed to the inner edges of said semi-circular and side portions.

10. The device defined by claim 1 in which the material-containing chamber has a second purge port in the top wall of the canister adjacent the second intake port.

11. The device defined by claim 10 including perforated plate means within the material-containing chamber spaced from and opposed to the second intake port and the second purge port.

* * * * *